US006824646B2

(12) United States Patent
Izumi et al.

(10) Patent No.: US 6,824,646 B2
(45) Date of Patent: Nov. 30, 2004

(54) PROCESS FOR OXYGEN BLEACHING AND ENZYME TREATING LIGNOCELLULOSIC PULP WITH LIQUID TREATMENT AND RECOVERY

(75) Inventors: Yoshiya Izumi, Tokyo (JP); Jun Sugiura, Kawasaki (JP); Hitoshi Kagawa, Yokohama (JP); Naoya Azumi, Chiba (JP)

(73) Assignee: OJI Paper Co., Ltd., Tokyo (JP)

( * ) Notice: Subject to any disclaimer, the term of this patent is extended or adjusted under 35 U.S.C. 154(b) by 0 days.

(21) Appl. No.: 10/126,946

(22) Filed: Apr. 22, 2002

(65) Prior Publication Data

US 2002/0174962 A1 Nov. 28, 2002

Related U.S. Application Data

(63) Continuation-in-part of application No. 09/533,887, filed on Mar. 22, 2000, now abandoned.

(30) Foreign Application Priority Data

Mar. 23, 1999 (JP) ..... 11-077549
Aug. 13, 1999 (JP) ..... 11-229068

(51) Int. Cl.[7] ..... D21C 9/147; D21C 11/00

(52) U.S. Cl. ..... 162/38; 162/42; 162/43; 162/45; 162/65; 162/72; 210/651; 210/652; 435/277; 435/278

(58) Field of Search ..... 162/29, 30.1, 65, 162/72, 38, 41, 42, 43, 44, 45; 435/277, 278; 210/651, 652, 702, 732; 127/37

(56) References Cited

U.S. PATENT DOCUMENTS

| | | | | |
|---|---|---|---|---|
| 4,908,311 | A | 3/1990 | Sasaki et al. | 435/101 |
| 4,946,556 | A | 8/1990 | Prough | 162/60 |
| 5,179,021 | A | 1/1993 | Du Manoir et al. | 435/278 |
| 5,551,515 | A | 9/1996 | Fodge et al. | 435/281 |
| 5,618,386 | A | 4/1997 | Arbeloa et al. | 162/72 |
| 5,723,328 | A | 3/1998 | Dalboege et al. | 435/209 |
| 5,736,384 | A | 4/1998 | Fukunaga et al. | 435/278 |
| 5,766,478 | A | 6/1998 | Smith et al. | 210/651 |

FOREIGN PATENT DOCUMENTS

| | | | |
|---|---|---|---|
| EP | 0 265 970 | A2 | 5/1988 |
| EP | 0 301 522 | A2 | 2/1989 |
| EP | 0 395 792 | A | 11/1990 |
| EP | 0395792 | A2 | 11/1990 |
| EP | 0408803 | A1 | 1/1991 |
| JP | 02-286695 | A | 11/1990 |
| JP | 04272289 | | 9/1992 |
| JP | 2000-333692 | A | 12/2000 |
| WO | WO 88/03190 | | 5/1988 |
| WO | WO 9102840 | | 3/1991 |
| WO | WO 91/02840 | | 3/1991 |
| WO | WO 9420672 | | 9/1994 |
| WO | WO 98/15581 | | 4/1998 |
| WO | WO 9815581 | | 4/1998 |

OTHER PUBLICATIONS

Translation of Japanese Patent Application 2001–55679–A.*

Paice et al, "Viscosity–Enhancing Bleaching of Hardwood Kraft Pulp with Xylanase From a Cloned Gene", Biotech & Bioeng. vol. 32, pp. 235–239 (1988).

Viikari, et al., "Bleaching with Enzymes", Proceedings from the Int'l Conf on Biotech in the Pulp and Paper Ind: Advances in Applied and Fundamentals Research, pp. 67–69 (1986).

* cited by examiner

*Primary Examiner*—Steve Alvo
(74) *Attorney, Agent, or Firm*—Arent Fox PLLC

(57) ABSTRACT

Lignocellulose pulp is bleached by bleaching a pulp in aqueous alkali solution with oxygen and treating the pulp with a hemicellulase, while a liquid fraction delivered from the enzyme treatment step is separated from the hemicellulase treated reaction mixture, and subjected to a penetration treatment through a separation membrane, for example, reverse osmosis membrane, to separate a permeated fraction from a non-permeated fraction; the permeated fraction is fed to the alkali-oxygen bleaching (oxygen delignification) step and is used as a liquid medium of the bleaching system.

5 Claims, 2 Drawing Sheets

PROCESS FOR OXYGEN BLEACHING AND ENZYME TREATING LIGNOCELLULOSIC PULP WITH LIQUID TREATMENT AND RECOVERY

CROSS-REFERENCE TO RELATED APPLICATION

This application is a continuation-in-part of application Ser. No. 09/533,887, filed Mar. 22, 2000 and now abandoned.

BACKGROUND OF THE INVENTION

1. Field of the Invention

The present invention relates to a process for bleaching a lignocellulose pulp. More preferably, the present invention relates to a process for bleaching a lignocellulose pulp, which enables a consumption of auxiliary chemicals for bleaching to be reduced to a great extent.

2. Description of the Related Art

It is known that in an alkali-oxygen bleaching (an oxygen delignification) process, a pulp is bleached in a reaction vessel by heat-treating the pulp with an alkali and oxygen placed in the vessel under pressure to produce radicals of lignin and resin in the pulp and to oxidize-decompose the radicals of lignin and resin. In the alkali-oxygen bleaching process, currently a moderate consistency oxygen-bleaching process (pulp consistency=8 to 15% by weight) is mainly used, in view of the relationship between the cost of bleaching apparatus necessary in this process and the quality of the resultant pulp. This process is advantageous in that a COD load on the environment is low and a non-chlorine bleaching agent can be used in a reduced amount in rear stage or stages in a multiple stage bleaching step, and thus is utilized in many factories in the world. However, the alkali-oxygen bleaching (an oxygen delignification) process is disadvantageous in that when the lignin in the pulp is removed in an amount of about 50% by weight based on the total content of lignin, the pulp cellulose is significantly damaged, the yield of the pulp is reduced and the viscosity of the pulp is decreased. This disadvantage can be restricted to a certain extent by using a magnesium salt as an agent for restricting the decomposition of cellulose. However, this restriction of the cellulose decomposition is not sufficient in practice. Thus, to keep the viscosity of cellulose at a practically permissible level or more, the lignin must be retained in a certain content in the alkali-oxygen-bleached oxygen-delignified pulp, and thus the bleaching efficiency of the conventional alkali-oxygen bleaching process is not always satisfactory. Accordingly, an enhancement in the bleaching efficiency of the alkali-oxygen bleaching process greatly contributes to reducing the load on the environment and to decreasing the bleaching cost due to the bleaching chemicals.

There have been many attempts to improve the alkali-oxygen bleaching process. For example, Japanese Unexamined Patent Publication No. 4-272,289 discloses an improved alkali-oxygen bleaching (oxygen-delignification) process in which two alkali-oxygen bleaching (oxygen-delignification) apparatuses are arranged in series and a washing means is inserted between the two bleaching apparatus. Also, U.S. Pat. No. 4,946,556 (Japanese Unexamined Patent Publication No. 3-14,686) discloses an alkali-oxygen bleaching (oxygen-delignification) process using a plurality of alkali-oxygen bleaching (oxygen-delignification) apparatuses arranged in series and a plurality of washing means respectively attached to each of the bleaching apparatuses.

In these processes, merely the waste liquid delivered from each alkali-oxygen bleaching apparatus is washed by a countercurrent washing liquid and then is recovered into a pulp production step, and thus, the efficiency in delignification by the alkali-oxygen bleaching (oxygen-delignification) procedures and the whiteness of the bleached pulp are not satisfactorily enhanced.

Recently, various attempts have been made to reduce the load on the environment and to decrease the amounts of the bleaching and auxiliary chemicals employed in the rear stage or stages in the multiple stage bleaching procedure. In one attempt, a bleaching procedure using an enzyme, for example, xylase has been developed. For example, a bleaching method in which a pulp is treated with xylanase before the multi-stage bleaching procedure, is disclosed, for example, in Japanese Unexamined Patent Publication No. 2-264,087 (corresponding to U.S. Pat. No. 5,179,021), No. 2-293,486 (corresponding to European Patent No. 395,792) and No. 4-507,268 (corresponding to WO 91/02,840). Also, a bleaching method in which a pulp is treated with a lignin-decomposing enzyme before bleaching procedure, is disclosed in Japanese Unexamined Patent Publication No. 2-500,990 (corresponding to WO 88/03,190, No. 3-130,485 (corresponding to European Patent No. 408,803, and No. 4-316,689 (corresponding to U.S. Pat. No. 5,618,386).

The treatment of the pulp with the enzyme before the bleaching procedure is advantageous in that the enzyme treatment conditions are relatively moderate and thus the reduction in the mechanical strength and the yield of the bleached pulp is slight, but is disadvantageous in that the reaction rate is low, and thus a long time is necessary to complete the enzyme reaction, and the reduction in Kappa value of the bleached pulp is very small.

Recently, the treatment of the pulp with xylanase particularly has drawn the attention of the paper industry. In the xylanase treatment, the enzyme must be brought into close contact with the pulp fibers to generate the reaction of the enzyme. However, since xylan and lignin contained in the pulp fibers are polymeric and are unevenly distributed in three dimensions in the pulp fibers, and the xylanase per se is polymeric, it is difficult to bring the xylanase into close contact with the xylan or lignin distributed in the pulp fibers. Thus, a new method of carrying out the enzyme reaction with a high efficiency must be developed.

The utilization of the enzyme including xylanase for the paper and pulp industry is disclosed in detail in Pratima Bajpai, "Enzyme in Pulp and Paper Processing", published in 1998 by Miller Freeman Inc. Also, L. Viikari et al., "Biotechnol. Pulp Paper Ind. (Stockholm), pages 67 to 69, 1986, discloses a treatment of pulp with xylanase, and reports that the bleaching efficiency of pulp was improved by the xylanase treatment. Further, F. Mora et al., "Journal of Wood chemistry and Technology", (6) 2, pages 147 to 165, 1986, reported that the treatment of pulp with xylanase after the pulp was bleached with oxygen contributed to enhance the mechanical strength of the bleached pulp. These reports are, however, quite silent as to the utilization and recovery of a waste liquid delivered from the enzyme treatment system.

In the bleaching procedures wherein a hemicellulase, for example, xylanase, is used and the bleached pulp is washed by a countercurrent washing method, the resultant bleaching reaction product mixture contains organic substance produced by the reaction of the enzyme with the pulp material and containing saccharide as a main component, and the saccharide-containing organic substance causes the countercurrent washing procedure to be difficult. Particularly, where the hemicellulase treatment is applied to the pulp material after the alkali-oxygen bleaching procedure, the organic substance containing saccharide produced by the hemicellulase treatment is returned into the alkali-oxygen bleaching (oxygen delignification) procedure through the countercurrent washing procedure, since a waste liquid delivered from the washing procedure is returned into the alkali-oxygen bleaching procedure.

It is well known that in the alkali-oxygen bleaching procedure, oxygen radical generated under the alkalin condition reacts with organic substances other than lignin in the pulp and having reduction-functional groups. The reaction mixture delivered from the hemicellulase treatment contains a large amount of fragments of decomposed lignin, and polysaccharides, oligosaccharides, monosaccharides, resin acid and derivatives thereof, and is washed by the countercurrent washing procedure, and the waste liquid delivered from the washing procedures and containing the above-mentioned organic substances is returned into the alkali-oxygen bleaching procedure. In this case, the saccharide molecules contained in the returned waste liquid have aldehyde groups which exhibit a reduction property. Thus in the alkali-oxygen bleaching reaction system, the returned saccharides react with oxygen so that the oxygen supplied into the bleaching system is wastefully consumed. Also, the saccharides reacted with oxygen are oxidized and converted to organic acids. The resultant organic acid molecules have carboxyl groups which cause the pH value of the bleaching system to be shifted to acid side, and thus the bleaching activity of the alkali-oxygen bleaching system is deteriorated. In this condition, to maintain the pH value of the bleaching system within a high alkalin range, and the delignification efficiency of the bleaching system at a high level, the alkali and oxygen must be respectively fed in increased amounts into the bleaching system. For this purpose, an attempt has been made to increase the amount of the white oxidation liquid fed into the bleaching system and to supplement the alkali consumed by the reaction with the saccharides. However, this attempt is disadvantageous in that the cost of the pulp production is increased, the delignification efficiency is unsatisfactory and the Kappa value of the resultant pulp is not satisfactorily low.

Also, according to Japanese Unexamined Patent Publication No. 63-112,979, in a method of recovering xylooligosaccharide from a filtrate of a reaction mixture prepared by treating hardwood xylan with xylanase derived from Trichoderma, the filtrate is decolored by activated carbon, the activated carbon is removed from the filtrate by using a filter press, the saccharide absorbed in the activated carbon is recovered by using a 15% ethanol, the recovered saccharide is treated with an ion-exchange resins (trademark: AMBERLITE IR-120B and AMBERLITE IR-410, to remove salts, and then is concentrated by a reverse osmosis membrane to obtain xylooligosaccharide containing xylobiose in a high content.

These publications are, however, quite silent as to the recovery and refining of xylooligosaccharides from a filtrate prepared from a reaction mixture in which a chemical pulp is treated with hemicellulase.

It is known that the xylanase treatment applied to the kraft pulp enables the necessary amount of bleaching chemicals for the bleaching process for the pulp with the bleaching chemical to be reduced. In the xylanase treatment, since the xylan contained in the pulp is hydrolyzed with xylanase, the resultant waste water discharged from the bleaching system contains xylose and xylooligosaccharide separated from the pulp in large amount. In paper industry, to reduce the amount of process water used, an amount of water used in a step of the bleaching procedure is returned to and utilized in another step before the above-mentioned step. Therefore, the water used in a step before the enzyme treatment step contains xylan-decomposition products, for example, xylose and xylooligosaccharide, isolated by xylanase.

The above-mentioned xylose and xylooligosaccharide have reducing terminal groups, for example, aldehyde groups, the reducing terminal groups are oxidized in the oxidation-bleaching procedure, for example, an oxygen-bleaching procedure and the xylose and xylooligosaccharide are converted to carboxylic acids and further to oxidized furan derivatives and then to colored furan condensation products, to consume the bleaching chemicals. Thus, in this case, the bleaching agents consumed due to the presence of the saccharides must be supplemented. Also, in the oxygen bleaching procedure under a high alkaline condition, the aldehyde groups are oxidized and the resultant carboxylic acid causes the pH value of the bleaching system to be reduced. Thus the pH values of the bleaching system must be controlled to a desired level by increasing the amount of alkali to be added to the bleaching system to compensate the reduction in pH.

In an attempted method in which xylose and xylooligosaccharide produced by the xylanase treatment is not returned to a preceeding bleaching step, the reducing saccharides are removed from the waste water discharged from the enzyme treatment system, and the resultant saccharide-free waste water is returned to a preceeding bleaching step. However, the waste water from the pulp production is generated in a large amount, and thus the removal of the saccharide by a conventional method, for example, the reverse osmosis membrane method, causes a very large scale of apparatus to be provided. Therefore, the above-mentioned removal of saccharide has not yet been carried out at a low cost.

SUMMARY OF THE INVENTION

An object of the present invention is to provide a process for bleaching a lignocellulose pulp with a high efficiency, while utilizing a waste water delivered from an enzyme treatment step as a liquid medium of an alkali-oxygen bleaching step.

Another object of the present invention is to provide a process for bleaching a lignocellulose pulp, by bleaching a pulp by an alkali-oxygen bleaching procedure and treating the pulp with an enzyme, which process enables a waste water delivered from, in a countercurrent to, the enzyme treatment, for example, hemicellulose treatment to be returned to a preceeding alkali-oxygen bleaching step, without deteriorating the bleaching effect of the alkali-oxygen bleaching procedure.

Still another object of the present invention is to provide a process for bleaching a lignocellulose pulp, while recovering xylooligosaccharide contained in a waste liquid delivered from an enzyme treatment step with a high efficiency and in a low cost, and while preventing a reduction in bleaching effect due to the presence of the xylooligosaccharide, in an alkali-oxygen bleaching system.

The above-mentioned objects can be attained by the process of the present invention for bleaching a lignocellulose pulp.

The bleaching process of the present invention for a lignocellulose comprises the steps of:

(1) bleaching a pulp in an aqueous alkali solution with oxygen; and (2) enzyme-treating the pulp with hemicellulase to an extent such that a liquid fraction containing succharides in an total amount of 2 to 6 mg/ml is produced in the resultant reaction mixture;

(3) filtering the resultant reaction mixture delivered from the enzyme-treating step (2) to recover the enzyme-treated pulp separated from the liquid fraction of the reaction mixture;

(4) subjecting the liquid fraction delivered from the filtration step (3) to a permeation treatment through a separation membrane to separate a permeated fraction from a non-permeated fraction; and (5) feeding the resultant permeated fraction delivered from the permeation treatment step (4) and containing succharides in a total content of 0.3 to 1.2 mg/ml, to the alkali-oxygen bleaching step (1) to use it as a liquid medium of the alkali-oxygen bleaching step (1).

In the bleaching process of the present invention, preferably the enzyme treatment step (2) is carried out after the alkali-oxygen bleaching step (1).

In the bleaching process of the present invention, the enzyme treatment is preferably carried out by using, as a hemicellulase, xylanase.

In the bleaching process of the present invention, the permeation treatment using the separation membrane is preferably carried out by using a membrane for reverse osmosis or for nanofiltration.

In the bleaching process of the present invention, the liquid fraction of the filtration step (3) is mixed with a flocculant selected from the group consisting of inorganic flocculants and polymeric flocculants, the resultant flocculate is removed from the liquid fraction, the flocculate-free filtrate is subjected to the permeation treatment step (4) using the separation membrane.

DESCRIPTION OF THE PREFERRED EMBODIMENTS

Figure 1:
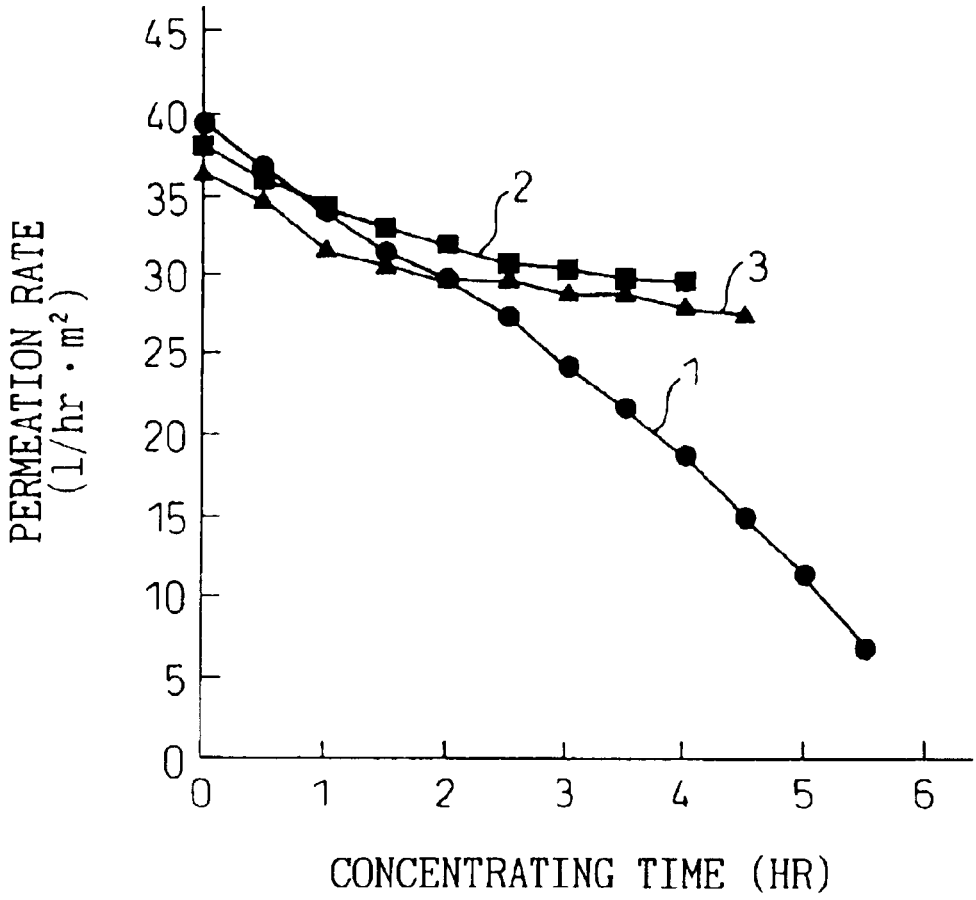
FIG. 1 is a graph showing relationship between the concentrating times and the permeation rates of the filtrates subjected to the reverse osmosis treatment in Example 5.

The inventors of the present invention have made extensive research into the influence of waste water delivered from an enzyme treatment for a pulp and employed as a liquid medium for bleaching a pulp by an alkali-oxygen bleaching (oxygen delignification) procedure, in an countercurrent relationship to the stream of the pulp in the bleaching procedure, on the bleaching effect, and found that when the waste water from the enzyme treatment is subjected to a separation membrane treatment, for example, a reverse osmosis (RO) membrane treatment or a nanofiltration (NF) membrane treatment, the resultant permeated fraction contains substantially no or very little saccharide and lignin which affect the bleaching effect of the pulp with oxygen in an aqueous alkali solution, and is usable as a liquid medium of the alkali-oxygen bleaching system for the pulp, without affecting the bleaching effect.

The present invention was completed on the basis of the above-mentioned findings.

In the pulp-bleaching process of the present invention, there is no limitation to the sort of the lignocellulose pulp usable for the bleaching process. The lignocellulose pulp is preferably selected from softwood pulps and hardwood pulps and optionally selected from non-wood plant pulps, for example, kenaf, flax, bagasse and rice plant pulps. The pulp usable for the bleaching process of the present invention include chemical pulps, mechanical pulps and deinked waste paper pulps. Preferably the hardwood chemical pulps are used for the bleaching process of the present invention.

The chemical pulps can be produced by a conventional pulping method, for example, kraft pulping, polysulfite pulping, soda pulping or alkali-sulfite pulping method. In consideration of the quality of the resultant pulp and the energy efficiency of the pulping procedure, the kraft pulping method is preferably utilized. For example, in this case where wood chips are subjected to the kraft pulping procedure, preferably the kraft pulping liquid has a sulfidity of 5 to 75%, more preferably 15 to 45%, the content of effective alkali in the kraft pulping liquid is 5 to 30% by weight, more preferably 10 to 25% by weight, based on the bone-dry weight of the wood, the pulping temperature is 140 to 170° C., and the pulping procedure is carried out in a continuous system or in a batch system. When a continuous pulping apparatus is used, the apparatus may have a plurality of inlets for supplying the pulping liquid into the pulping apparatus. There is no limitation to the type of the continuous pulping apparatus.

In the pulping procedure, the pulping liquid optionally contains a pulping auxiliary comprising at least one member selected from the group consisting of cycloketo compounds, for example, benzoquinone, naphthoquinone, anthraquinone, anthorone and phenanthraquinone; alkyl and/or amino group-substituted derivatives of the cycloketo compounds; hydroquinone compounds, for example, anthrahydroquinone, which are reduction products of the above-mentioned quinone compounds; and 9,10-diketohydroanthracene compounds which are obtained as a by product in synthesis of anthraquinone compounds by a Diels-Alder reaction and have a high chemical stability. The bleaching auxiliary is added in an amount of 0.001 to 1.0% by weight based on the bone dry weight of the wood chips to the bleaching system.

The alkali-oxygen bleaching procedure for the process of the present invention may be carried out in accordance with the conventional moderate consistency method or high consistency method. Preferably, the bleaching procedure is carried out in accordance with the moderate consistency method in a pulp concentration of 8 to 15% by weight, which method is currently commonly employed.

In the alkali-oxygen bleaching procedure in accordance with the moderate consistency method, preferably an aqueous sodium hydroxide solution or an oxidized kraft white liquor is used as an aqueous alkali solution, and the oxygen gas is selected from those prepared by cryogenic separation method, by PSA (pressure swing adsorption) method and by VSA (vacuum swing adsorption) method. The oxygen gas and the aqueous alkali solution is mixed into an aqueous pulp slurry having a moderate consistency of the pulp by using a moderate consistency mixer, and after they are fully mixed with each other, the mixture containing the pulp mixed with oxygen and alkali is fed under pressure into a bleaching reaction column which has capacity large enough to store the mixture for a desired time, to delignify the pulp.

In the bleaching procedure, the oxygen is employed in an amount of 0.5 to 3% by weight based on the bone-dry weight of the pulp, the alkali is employed in an amount, in terms of NaOH, of 0.5 to 4% by weight based on the bone dry weight of the pulp, the reaction time is 15 to 100 minutes and the consistency of the pulp is 8 to 15% by weight. Other conditions for the bleaching procedures may be established in accordance with the conventional bleaching processes.

In a preferable embodiment of the bleaching method of the present invention, preferably the alkali-oxygen bleaching procedure is continuously carried out plural times to promote the delignification of the pulp as much as possible.

In the enzyme treatment procedure, preferably a bleached pulp mixture delivered from the alkali-oxygen bleaching step of the lignocellulose pulp is fed into the enzyme treatment system. However, when the bleached pulp mixture contains a chlorine-containing bleaching chemical or chlorine ions in a large amount, a filtrate prepared from the bleached pulp mixture is not preferred to be employed in the enzyme treatment, because when the filtrate is used in the enzyme treatment and then returned to a pulping step through a countercurrent washing step, scale may be generated on the inside surface of the pulping apparatus, or when returned to a black liquor-recovery boiler step, liquid-transporting pipes may be corroded.

The enzyme usable for the enzyme treatment step of the process of the present invention is preferably selected from hemicellulase, much as xylanase, manganese peroxidase and laccase mediator system. In the present time, the enzyme practically utilized for a large scale of enzyme treatment is mostly selected from hemicellulase. All the trade-available hemicellulase can be used for the enzyme treatment step of the process of the present invention. For example, hemicullulase-containing agents available in trade under the trademark of CALTAZYME, made by CLARIANT CO., ECOPULP, made by RHOM ENZYME FINLAND OY, or SUMIZYME, made by SHINNIHON CHEMICAL CO., and xylanase produced by microorganisms in genus Tricoderma, genus Termomyces, genus Aureobasidium, genus Streptomyces, genus Aspergillus, genus Clostridium, genus Bacillus, genus Dermatoga, genus Thermoascus, genus Cardoceram and genus Thermomonospora, can be employed. Such hemicellulase contributes to enhancing the bleaching efficiency in the enzyme treatment step by decomposing and removing the hemicellulose in the chemical pulp.

The enzyme treatment in the process of the present invention is preferably carried out in a pulp consistency of 1 to 30% by weight, more preferably 2 to 15% by weight. When the pulp consistency is less than 1% by weight, a large capacity of the treatment apparatus may be necessary and this may be disadvantageous in practice. When the pulp consistency is more than 30% by weight, the pulp may be difficult to be uniformly mixed with the enzyme or the culture product of the enzyme.

The enzyme treatment is preferably carried out at a temperature of 10 to 90° C., more preferably 30 to 60° C. The treatment temperature is preferably close to the optimum temperature of the enzyme. In the case of common enzyme, when the treatment temperature is less than 10° C., the enzyme reaction may be insufficient and it may be very costly to maintain the enzyme treatment system at the low temperature of less than 10° C. Also, when the treatment temperature is more than 90° C., it may be necessary to tightly seal the treatment apparatus to prevent a heat loss, and the common enzyme may be modified and inactivated.

The enzyme treatment system preferably has a pH value of 3 to 10, more preferably 5 to 9, which should be close to the optimum pH value for the enzyme. If necessary, the pH value of the enzyme treatment system can be adjusted to a desired value by adding an aqueous acid or alkaline solution to the system. Of course, the pH adjustment can be effected by using a waste water delivered from the multi-stage bleaching step.

There is no limitation to the treatment time of the enzyme treatment procedure. Usually, the enzyme treatment time is preferably 10 minutes or more, more preferably 30 to 180 minutes.

The enzyme treatment procedure may be effected in a single stage or in multiple stages. The multiple enzyme treatment procedures may be carried out by using the same enzyme as each other, or by using two or more types of enzymes different from each other. The enzyme treatment procedure in the process of the present invention can be carried out in any container, for example, reactor column, tank, or chest, which may be new or not new. The enzyme treatment procedure may be carried out in a pressure-resistant container under pressure.

The reaction mixture delivered from the enzyme treatment procedure of the chemical pulp in accordance with the process of the present invention contains various types of saccharides such as xylooligosaccharides including xylose and xylobiose, which are produced from hemicellulose in the pulp, and cellooligosaccharides including cellulose and cellobiose, which are produced from cellulose in the pulp. For example, a xylanase of Bacillus sp. S-2113 strain (disclosed in Japanese Unexamined Patent Publication No. 8-224,081) is utilized, the resultant xylooligosaccharides generated in the reaction mixture of the enzyme treatment contain xylose and polymers of xylose from which the xylooligosaccharides are constituted, and the total content of trimers, tetramers and pentamers of xylose in the xylooligosaccharides is high and the content of monomer of xylose is low. These xylooligosaccharides have a relatively high molecular weight and can be easily concentrated and removed by the separation membrane treatment.

The separation membrane for concentrating the saccharides in the waste liquid discharged from the enzyme treatment of the pulp may be selected from conventional separation membranes as long as they can concentrate and remove the saccharides and colored organic substances, for example, lignin, contained in the waste liquid from the enzyme treatment for the pulp.

The waste water from the enzyme treatment using, for example, hemicellulase is filtered through a filter having 50 μm size openings to remove water-insoluble substances, and the resultant filtrate is subjected to a separation membrane treatment, for example, a reverse osmosis membrane treatment, the resultant non-permeated fraction contains monosaccharides, for example, glucose, xylose, arabinose and mannose together with xylooligosaccharides, cellooligosaccharides and lignin, in an increased content. Namely, when the reverse osmosis membrane is used, all the saccharides contained in the reaction mixture of the hemicellulase treatment for the pulp can be recovered in substantially 100% yield. Also, the permeated fraction of the reaction mixture through the separation membrane is substantially free from the saccharides.

In place of the reverse osmosis membrane, a separation membrane for nanofiltration can be used. The concentration and removal efficiency of the nanofiltration membrane (NF membrane) for the saccharides is, however lower than that of the reverse osmosis membrane. When the nanofiltration membrane is used as a separation membrane for the waste liquid delivered from the hemicellulase treatment of the pulp, the saccharides contained in the waste liquid are recovered in a recovery yield of about 70% by weight based on the total weight of the saccharides. However, the permeated fraction of the waste liquid contains saccharides in an amount of about 30% by weight based on the total weight of the saccharides in the waste liquid.

To provide a washing water having a low content of organic substances for a countercurrent washing procedure for the bleached pulp, by concentrating and removing the saccharides and lignin having a high solubility in water and a relatively high molecular weight, a method in which the waste water from the enzyme treatment is treated through a separation membrane to remove the organic substances, is advantageously utilized in industry. The reason for the advantage is that a large amount of waste water can be treated by a relatively small size of separation apparatus, with a relatively low operation cost, without using specific chemicals, for example, solvent. Another reason is that the separation membrane can separate and remove the monosaccharides and oligosaccharides together with various organic substances derived from lignin contained in the reaction mixture of the enzyme treatment.

As mentioned above, the separation membrane treatment of the discharged liquid from the hemicellulase treatment system by using the reverse osmosis membrane or the NF membrane enables the saccharides contained in the discharged water to be removed in an amount of at least about 70% by weight based on the total weight of the saccharides. Also, in this separation membrane treatment, other organic substances derived from lignin are removed. Thus the permeated fraction of the discharged liquid through the separation membrane is excellent as a washing water for the pulp delivered from the bleaching system, by the countercurrent washing method. The bleaching result on the pulp by the alkali-oxygen bleaching procedure using the discharged liquid of the hemicellulase treatment without the separation membrane treatment is significantly different from that using the discharged liquid treated by the separation membrane treatment.

In the alkali-oxygen bleaching (oxygen delignification) procedure, an alkali must be added to the bleaching system to keep the pH value of the bleaching system on the alkaline side. The saccharides in the discharged liquid from the hemicellulase treatment are oxidized in the alkali-oxygen bleaching procedure and are converted to organic acids such as furan carboxylic acid having at least one carboxyl group. The organic acids cause the alkali contained in the alkali-oxygen bleaching system to be fruitlessly consumed. Thus, the content of the alkali in the bleaching system must be previously increased to compensate for the fruitless consumption of the alkali. In the conventional bleaching process including no hemicellulase treatment, the countercurrent washing water usually has a total saccharide content of 0.5 to 1 mg/ml. However, in the bleaching process of the present invention having the hemicellulase treatment is carried out to an extent such that a liquid fraction, for example, a countercurrent washing water, containing succharides in a total content of 2 to 6 mg/ml is produced.

Where the alkali-oxygen bleaching (oxygen delignification) procedure is carried out by using the liquid fraction (countercurrent washing water) having an increased saccharide content, an excessive amount of alkali must be added to the bleaching system in consideration of the increase in the saccharide content in the washing water. For example, where a countercurrent washing water having a total saccharide content of about 2 mg/ml is employed, the alkali must be added in an amount of about 1% in addition to the amount (about 1.2%) of the alkali necessary to produce the bleached pulp having the same kappa value as that of the bleached pulp produced by using the above-mentioned washing water, to the bleaching system. Namely the total amount of the alkali is about 2.2% (1.2+1.0). The use of the excessive amount of the alkali causes the bleaching cost to be increased.

When the alkali-oxygen bleaching (oxygen delignification) procedure is carried out by using the liquid fraction (countercurrent washing liquid) containing various saccharides and lignin materials and having a total saccharide content of about 2 mg/ml without compensating for the fruitless consumption of the alkali, the whiteness of the resultant bleached pulp is about 1.5 points below that of the bleached pulp obtained by a usual alkali-oxygen bleaching procedure using a countercurrent washing water having low contents of saccharides and lignin materials and a total saccharide content of about 0.5 mg/ml.

However, when the total saccharide content of the liquid fraction discharged from the hemicellulase treatment of the pulp and then permeated through the separation membrane treatment is controlled to a level of about 0.5 mg/ml or less, and the resultant permeated fraction is used as a liquid medium for the alkali-oxygen bleaching (oxygen delignification) system, the content of organic substances such as saccharides in the liquid medium is low, and thus no addition of the alkali in an excessive amount to the bleaching system is necessary, and no decrease in whiteness of the bleached pulp is found.

The alkali-oxygen bleaching (oxygen delignification) system may be prepared by using, as a diluting water, a permeated fraction obtained by subjecting a liquid fraction discharged from a later stage of the alkali-oxygen bleaching (oxygen delignification) procedure to a separation membrane treatment. The permeated fraction delivered from the permeation procedure must have a total content of succharides certainly lower than 2 mg/ml, namely 0.3 to 1.2 mg/ml, preferably 0.5 to 1.0 mg/ml. In this case, the oxygen bleaching effect can be enhanced to a certain extent, but the membrane treatment for the reaction mixture delivered from the bleaching procedure is very costly, and thus is not practically utilizable.

In the process of the present invention, since the large amount of the saccharides and lignin produced in the hemicellulase treatment of the pulp can be concentrated and removed by the separation membrane treatment, the saccharide content and the lignin content of the countercurrent washing water which are repeatedly employed, can be stabilized at a low level. Therefore, the efficiency of the alkali-oxygen bleaching (oxygen delignification) procedure and the pulping procedure, which are carried out in the former stages of the bleached pulp-producing process, and in which the countercurrent washing procedure is carried out, can be enhanced. Also, since the amount of the organic substances, such as saccharides, introduced into the later stages of the bleached pulp-producing procedure can be reduced, the efficiency of the bleaching procedure using an oxidative bleaching agent in the later stages of the bleached pulp-producing procedure can be enhanced. Further, the amount of the organic substances contained in the total waste water discharged from the bleaching procedure can be reduced. Thus the COD of the last waste water can be reduced.

In the process of the present invention, the enzyme treatment step for the pulp may be carried out before or after the alkali-oxygen bleaching (oxygen delignification) step.

Generally, the lignocellulose pulp is treated by the enzyme treatment, and the resultant pulp is subjected to a single or multiple step bleaching procedure. In the single step bleaching procedure, the bleaching chemicals are mainly selected from hydrogen peroxide which will be represented by (P), hereinafter, hydrosulfite and thiourea dioxide. Also, in the multiple step bleaching procedures, elemental chlorine (which will be represented by (C)), sodium hydroxide (E), hypochlorite salt compound (H), chlorine dioxide (D), oxygen (D), hydrogen peroxide (P), ozone (Z), sulfuric acid (A) and organic peracids are used as bleaching agents. These bleaching agents can be employed in combination with an auxiliary bleaching chemical.

The multi-step bleaching procedure of the bleaching process of the present invention may be carried out in the following sequences.

C-E/O-H-D and C/D-E/O-H-D

In these sequences, an elemental chlorine bleaching step (C) and/or chlorine-containing chemical bleaching step (H) is included.

D-E-D, D-E/O-D, Z-E/O-D, and A-D-E/O-D

In these sequences, no atomic chlorine (C) is employed.

Z-E-P, Z-E/O-P and A-Z-E/O-P

In these sequences, no elemental chlorine (C) and no chlorine-containing chemical (H) are employed.

In the process of the present invention, an enzyme (hemicellulase) treatment is applied to a pulp, a reaction mixture delivered from the enzyme treatment system is filtered to recover the treated pulp, the filtrate is subjected to a separation membrane treatment to provide a non-permeated fraction through the separation membrane in which the organic substances including saccharides and lignin are concentrated, and a permeated fraction through the separation membrane which contains substantially no the saccharides and lignin, or a very small amount of the saccharides and lignin.

The permeated fraction is used as a liquid medium for the alkali-oxygen bleaching (oxygen delignification) system and as a washing water for a countercurrent washing procedure for the bleached pulp. By using the permeated fraction of the reaction mixture delivered from the enzyme treatment system, through the separation membrane, the alkali-oxygen bleaching procedure can be effected with a high efficiency. The procedures for collecting xylooligosaccharide from the reaction mixture of the enzyme treatment will be further explained below.

In the bleaching process of the present invention, a reaction mixture delivered from the enzyme treatment system for a pulp is filtered to collect the treated pulp from the reaction mixture, the resultant filtrate, namely a liquid fraction of the reaction mixture is subjected to a permeation treatment through a separation membrane to separate a permeated fraction and a non-permeated fraction. In the non-permeated fraction, xylooligosaccharide-lignin complex is concentrated. The concentrated xylooligosaccharide is separated from the non-permeated fraction.

In the process of the present invention, the enzyme treatment is carried out by using hemicellulase, the resultant reaction mixture delivered from the enzyme treatment step is filtered to collect the treated pulp, the resultant liquid fraction (filtrate) is preferably mixed with a flocculant selected from the group consisting of inorganic flocculants and cationic polymeric flocculants, the resultant flocculate is removed from the filtrate, the flocculate-free filtrate is subjected to a permeation treatment through a separation membrane, the resultant non-permeated fraction containing xylooligosaccharide complex in an increased concentration is collected and subjected to a procedure for separating and collecting xylooligosaccharide from the non-permeated fraction.

The enzyme for the enzyme treatment is selected from those as mentioned above.

The reaction mixture delivered from the enzyme treatment system is filtered to recover the enzyme-treated pulp, and a liquid fraction (filtrate) containing various saccharide is collected. The proportions of xylose and xylooligosaccharide contained in the filtrate are variable in response to the type of the enzyme used in the enzyme treatment, and thus the filtrate contains, as a major component of the saccharide, sometimes xylose, or xylobiose, or xylotriose. For example, when in the enzyme treatment, Bacillus sp. S-2113 strain is used, the resultant filtrate obtained from the reaction mixture delivered from the enzyme treatment contains xylose tetramer as a highest content component and xylose monomer as a low content component. When a hardwood kraft pulp is used, the filtrate contains substantially no glucose and arabinose, and xylose is contained in a content close to 100% based on the total content of saccharides, in the filtrate.

The filtrate is filtered through a filter with 5 $\mu$m size openings to remove insoluble substances, and then subjected to a permeation treatment through a reverse osmosis membrane. In the resultant permeated fraction, xylose, glucose, arabinose and xylooligosaccharide are detected. The total content of the all the saccharides in the permeated fraction is about 30% by weight based on the total content of the all saccharides in the filtrate. Also, in the non-permeated fraction remained in the inlet side of the reverse osmosis membrane, very small contents of oligosaccharide and monosaccharide are detected. However, about 70% by weight of all the saccharides contained in the filtrate are recovered, in the form of xylooligosaccharide-lignin complex, in the non-permeated fraction. For the permeation treatment, a membrane for nanofiltration which membrane is referred to a nanofillration, and is used in the electrically charged state, may be used in place of the reverse osmosis membrane. The nanofiltration membrane exhibit a rejection to common salt (NaCl) of about 50% and can be employed in the same manner as the reverse osmosis membrane. When the nanofiltration membrane is used for the permeation treatment, the total recovery of all the saccharides is about 70% which is similar to that by the reverse osmosis membrane. A conventional ultrafiltration membrane may be utilized for the permeation treatment. In this case, the total recovery of all the saccharides is about 30%.

The xylooligosaccharide-lignin complex contained in the reaction mixture delivered from the enzyme-treatment system for the pulp can be concentrated by conventional physical and/or chemical procedures, for example, evaporation, flocculation-deposition, and extraction in a solvent. However, a separation method in which the target xylooligosaccharide is allowed to permeate through a membrane which does not allow the xylooligosaccharide complex to permeate therethrough, and the complex is concentrated in the inlet side of the membrane, is advantageously employed in industry. This permeation treatment is advantageous in that no use of specific substances, for example, solvent is necessary, and the operation cost is low. Also, this treatment is advantageous in that the xylooligosaccharide can be separated and removed, together with various inorganic substances, for example, sodium carbonate and sodium, and organic substances, for example, monosaccharides such as dextrose, xylose and arabinose, oligosaccharides, organic acids and low molecular weight organic substances derived from lignin and others.

When the permeation treatment by using the separation membrane, for example, reverse osmosis membrane or ultrafiltration membrane is carried out, colloidal substances or suspended particles in the filtrate are adhered to and accumulated on the surface of the membrane, the specific resistance of the membrane to permeation increases with the lapse of operation time, and the permeation rate of the filtrate through the membrane is decreased. In practice, it is important that the deterioration in the permeation performance of the membrane or membrane module is minimized, and the permeation performance is stabilized over a long operation time. For this purpose, the filtrate is subjected to a pre-treatment for removing the above-mentioned colloidal substances and particles, for example, a flocculation and deposition treatment or filtration treatment, before the permeation treatment. The filtrate obtained from the reaction mixture delivered from the hemicellulase treatment system contains lignin, antifoamer and fine insoluble substances which are difficult to remove by the filtration using a usual filter, and are suspended in the filtrate, and the suspended substance causes the permeation rate of the filtrate through the membrane to be decreased. The decrease in the permeation rate can be prevented by a pre-treatment in which a flocculant is added to the filtrate and the resultant flocculate is removed from the filtrate to make the filtrate clear. The flocculant usable for the pre-treatment preferably comprises at least one member selected from inorganic flocculants, for example, aluminum sulfate and poly(aluminum chloride); synthetic polymeric flocculants, for example, polyacrylamides and polyamines; and natural polymeric flocculants, for example, chitosan. The amount of the flocculant to be added to the filtrate is established in consideration of the type of the flocculant and the composition of the filtrate to be treated. The aluminum sulfate is used in an amount of 500 to 1000 ppm based on the weight of the filtrate, and the pH value of the aluminum sulfate-added filtrate is adjusted to 7.5 by adding sodium hydroxide. The synthetic polymeric flocculant is employed in an amount of about 5 to 30 ppm and chitosan is employed in an amount of about 30 to 60 ppm. The flocculate generated in the filtrate is removed by using a centrifugation or other filter, for example, precoat filter, bag filter or filter press. After the filtrate is pre-treated by the flocculation and flocculate-removal, the resultant filtrate exhibits a higher degree of clarity than that of the non-pretreated filtrate, and thus the decrease in the permeation rate of the filtrate in the permeation treatment can be prevented.

EXAMPLES

The present invention will be further illustrated by the following examples, which are merely representative but are not intended to restrict the scope of the present invention in any way.

In the examples, a non-bleached pulp obtained by pulping wood chips was subjected to a delignification and bleaching process including an alkali-oxygen bleaching procedure, and an enzyme treatment procedure, a reaction mixture delivered from the enzyme treatment procedure was filtered, the filtrate was subjected to a permeation treatment through a separation membrane, and the permeated fraction was employed as a liquid medium for the alkali-bleaching step.

In the comparative examples, the filtrate obtained from the reaction mixture of the enzyme treatment was employed as a liquid medium for the alkali-oxygen bleaching step, without subjecting it to the permeation treatment.

The filtrate and the permeated fraction of the filtrate were prepared by the following procedures.

Unless particularly indicated, a reduction rate in kappa value and an increase rate in whiteness of the pulp due to the alkali-oxygen delignification were calculated as shown follow.

The amounts of the chemicals employed in the examples and comparative examples were indicated in % by weight based on the bone dry weight of the pulp.

1. Measurement of Total Saccharide Content

A calibration curve for all the saccharides was prepared by using D-xylose (made by WAKO JUNYAKUKOGYO K.K.) and the amount of the all the saccharide was determined in accordance with a phenol sulfuric acid method (disclosed in "Quantatine Analysis of Reduced Saccharides" published by GAKKAI SHUPPAN CENTER) using calibration curve.

2. Preparation of a Filtrate of Reaction Mixture Delivered from Enzyme Treatment System An alkali-oxygen bleached pulp in a total bone dry weight of 600.0 g was divided into five portions thereof each in an bone dry weight of 120.0 g and each portion was placed in a plastic resin bag. In each bag, the pulp was suspended in a consistency of 10% by weight in an ion-exchanged water adjusted to a pH value of 6.0 by using a concentrated sulfuric acid. In each bag, the aqueous pulp slurry was added with 120 $\mu$l of xylanase available under a trademark of Irgazyme 40A, made by Ciba-Gaigy. The content of the xylanase was 0.10% by weight based on the bone dry weight the pulp. The pulp was treated with xylanase at a temperature of 60° C. for 120 minutes. After the enzyme treatment was completed, the enzyme-treated pulp slurry was subjected to dehydration under suction by using a Buchner funnel formed from a 100 mesh wire sheet. A resultant filtrate was obtained in an amount of 3600 ml. The total saccharides contained in the enzyme treatment system were 4,000 $\mu$g/ml in terms of xylose.

3. Permeated Fraction Prepared by a Permeation Treatment

The filtrate obtained from the reaction mixture delivered from the enzyme treatment was subjected in an amount of 2,000 ml to a permeation treatment using a separation membrane available under a trademark of LOOSE RO 7450 HG (made by NITTO DENKO CORPORATION). A permeated fraction was obtained in an amount of 1800 ml. The permeated fraction had a total saccharide content of 500 $\mu$g/ml in terms of xylose.

4. Reduction Rate in Kappa Value of Pulp Due to Alkali-Oxygen Bleaching

The reduction rate in kappa value of pulp due to an alkali-oxygen bleaching procedure was calculated by measuring the kappa values of the pulp before and after the alkali-oxygen bleaching procedure in accordance with JIS P 8211, and by calculating the reduction rate in accordance with the following equation:

$$\text{Reduction rate in kappa value (\%)} = \frac{(K_1 - K_2)}{K_1} \times 100$$

wherein $K_1$ represents a kappa value of the pulp before the alkali-oxygen bleaching procedure and $K_2$ represents a kappa value of the pulp after the alkali-oxygen bleaching (oxygen delignification) procedure.

5. Increase Rate in Whiteness of Pulp Due to Alkali-Oxygen Bleaching

The increase rate in whiteness of a pulp due to an alkali-oxygen bleaching (oxygen delignificateion) procedure was determined by preparing a paper sheet having a basis weight of 60 g/m$^2$ in accordance with JIS P 8209; measuring the whitenesses of the pulp before and after the alkali-oxygen bleaching (oxygen delignification) procedure in accordance with JIS P 8123, and the increase rate in the whiteness was calculated in accordance with the following equation;

$$\textit{Increase rate in whiteness}\ (\%)=(W_2-W_1)/W_1\times 100$$

wherein $W_1$ represents a whiteness of the pulp before the alkali-oxygen bleaching procedure and $W_2$ represents a whiteness of the pulp after the alkali-oxygen bleaching procedure.

Example 1

In an alkali-oxygen bleaching procedure, a pulp slurry having a pulp content of 10% by weight was prepared by suspending a mixture of a hardwood unbleached kraft pulp produced in factory and having a whiteness of 32.7%, a kappa value of 16.1 and a pulp consistency of 37.2%, in a bone dry amount of 60.0 g with sodium hydroxide in an amount of 1.2% by weight based on the bone dry weight of the pulp, in a liquid medium consisting of the above-mentioned permeated fraction of the filtrate of the reaction mixture delivered from the enzyme treatment system arranged downstream from the alkali-oxygen bleaching system, through the above-mentioned separation membrane.

The pulp slurry was placed in an autoclave equipped with an indirect heating system, the inside of the autoclave was filled with a trade-available compressed oxygen gas having a degree of purity of 99.9%, under a gauge pressure of 490332.5 Pa (5 kg/cm$^2$), the pulp was heated at a temperature of 100° C. for 60 minutes in a moderate pulp consistency to bleach the pulp with oxygen in the aqueous alkali solution. The bleached pulp was washed with an ion-exchanged water, and dewatered. The resultant alkali-oxygen bleached hardwood pulp had a kappa value of 9.1 and a Hunter whiteness of 44.5%.

Table 1 shows the reduction rate in kappa value of the pulp and the increase rate in whiteness of the pulp due to the alkali-oxygen bleaching procedure, and the pH value of the bleaching system after the alkali-oxygen bleaching procedure was completed.

Example 2

In an alkali-oxygen bleaching procedure, a pulp slurry having a pulp content of 10% by weight was prepared by suspending a mixture of a hardwood unbleached kraft pulp produced in factory and having a whiteness of 32.7%, a kappa value of 16.1 and a pulp consistency of 37.2%, in a bone dry amount of 60.0 g with sodium hydroxide in an amount of 1.7% by weight based on the bone dry weight of the pulp, in a liquid medium consisting of the above-mentioned permeated fraction of the filtrate of the reaction mixture delivered from the enzyme treatment system arranged downstream from the alkali-oxygen bleaching system, through the above-mentioned separation membrane.

The pulp slurry was placed in an autoclave equipped with an indirect heating system, the inside of the autoclave was filled with a trade-available compressed oxygen gas having a degree of purity of 99.9%, under a gauge pressure of 490332.5 Pa (5 kg/cm$^2$), the pulp was heated at a temperature of 100° C. for 60 minutes in a moderate pulp consistency to bleach the pulp with oxygen in the aqueous alkali solution. The bleached pulp was washed with an ion-exchanged water, and dewatered. The resultant alkali-oxygen bleached hardwood pulp had a kappa value of 8.8 and a Hunter whiteness of 45.3%.

Table 1 shows the reduction rate in kappa value of the pulp and the increase rate in whiteness of the pulp due to the alkali-oxygen bleaching procedure, and the pH value of the bleaching system after the alkali-oxygen bleaching procedure was completed.

Example 3

In an alkali-oxygen bleaching procedure, a pulp slurry having a pulp content of 10% by weight was prepared by suspending a mixture of a hardwood unbleached kraft pulp produced in factory and having a whiteness of 32.7%, a kappa value of 16.1 and a pulp consistency of 37.2%, in a bone dry amount of 60.0 g with sodium hydroxide in an amount of 2.2% by weight based on the bone dry weight of the pulp, in a liquid medium consisting of the above-mentioned permeated fraction of the filtrate of the reaction mixture delivered from the enzyme treatment system arranged downstream from the alkali-oxygen bleaching system, through the above-mentioned separation membrane.

The pulp slurry was placed in an autoclave equipped with an indirect heating system, the inside of the autoclave was filled with a trade-available compressed oxygen gas having a degree of purity of 99.9%, under a gauge pressure of 490332.5 Pa (5 kg/cm$^2$), the pulp was heated at a temperature of 100° C. for 60 minutes in a moderate pulp consistency to bleach the pulp with oxygen in the aqueous alkali solution. The bleached pulp was washed with an ion-exchanged water, and dewatered. The resultant alkali-oxygen bleached hardwood pulp had a kappa value of 8.7 and a Hunter whiteness of 45.9%.

Table 1 shows the reduction rate in kappa value of the pulp and the increase rate in whiteness of the pulp due to the alkali-oxygen bleaching procedure, and the pH value of the bleaching system after the alkali-oxygen bleaching procedure was completed.

Comparative Example 1

In an alkali-oxygen bleaching procedure, a pulp slurry having a pulp content of 10% by weight was prepared by suspending a mixture of a hardwood unbleached kraft pulp produced in factory and having a whiteness of 32.7%, a kappa value of 16.1 and a pulp consistency of 37.2%, in a bone dry amount of 60.0 g with sodium hydroxide in an amount of 1.2% by weight based on the bone dry weight of the pulp, in a liquid medium consisting of the filtrate of the reaction mixture delivered from the enzyme treatment system arranged downstream from the alkali-oxygen bleaching system.

The pulp slurry was placed in an autoclave equipped with an indirect heating system, the inside of the autoclave was filled with a trade-available compressed oxygen gas having a degree of purity of 99.9%, under a gauge pressure of 490332.5 Pa (5 kg/cm$^2$), the pulp was heated at a temperature of 100° C. for 60 minutes in a moderate pulp consistency to bleach the pulp with oxygen in the aqueous alkali solution. The bleached pulp was washed with an ion-exchanged water, and dewatered. The resultant alkali-oxygen bleached hardwood pulp had a kappa value of 10.1 and a Hunter whiteness of 43.0%.

Table 1 shows the reduction rate in kappa value of the pulp and the increase rate in whiteness of the pulp due to the alkali-oxygen bleaching procedure, and the pH value of the bleaching system after the alkali-oxygen bleaching procedure was completed.

Comparative Example 2

In an alkali-oxygen bleaching procedure, a pulp slurry having a pulp content of 10% by weight was prepared by suspending a mixture of a hardwood unbleached kraft pulp produced in factory and having a whiteness of 32.7%, a kappa value of 16.1 and a pulp consistency of 37.2%, in a bone dry amount of 60.0 g with sodium hydroxide in an amount of 2.2% by weight based on the bone dry weight of the pulp, in a liquid medium consisting of the filtrate of the reaction mixture delivered from the enzyme treatment system arranged downstream from the alkali-oxygen bleaching system.

The pulp slurry was placed in an autoclave equipped with an indirect heating system, the inside of the autoclave was filled with a trade-available compressed oxygen gas having a degree of purity of 99.9%, under a gauge pressure of 490332.5 Pa (5 kg/cm$^2$), the pulp was heated at a temperature of 100° C. for 60 minutes in a moderate pulp consistency to bleach the pulp with oxygen in the aqueous alkali solution. The bleached pulp was washed with an ion-exchanged water, and dewatered. The resultant alkali-oxygen bleached hardwood pulp had a kappa value of 9.1 and a Hunter whiteness of 44.4%.

Table 1 shows the reduction rate in kappa value of the pulp and the increase rate in whiteness of the pulp due to the alkali-oxygen bleaching procedure, and the pH value of the bleaching system after the alkali-oxygen bleaching procedure was completed.

Comparative Example 3

In an alkali-oxygen bleaching procedure, a pulp slurry having a pulp content of 10% by weight was prepared by suspending a mixture of a hardwood unbleached kraft pulp produced in factory and having a whiteness of 32.7%, a kappa value of 16.1 and a pulp consistency of 37.2%, in a bone dry amount of 60.0 g with sodium hydroxide in an amount of 2.7% by weight based on the bone dry weight of the pulp, in a liquid medium consisting of the filtrate of the reaction mixture delivered from the enzyme treatment system arranged downstream from the alkali-oxygen bleaching system.

The pulp slurry was placed in an autoclave equipped with an indirect heating system, the inside of the autoclave was filled with a trade-available compressed oxygen gas having a degree of purity of 99.9%, under a gauge pressure of 490332.5 Pa (5 kg/cm$^2$), the pulp was heated at a temperature of 100° C. for 60 minutes in a moderate pulp consistency to bleach the pulp with oxygen in the aqueous alkali solution. The bleached pulp was washed with an ion-exchanged water, and dewatered. The resultant alkali-oxygen bleached hardwood pulp had a kappa value of 9.1 and a Hunter whiteness of 44.7%.

Example 4

Preparation of Bleached Pulp

A mixed hardwood chips consisting of 70% by weight of Japanese hardwood chips and 30% by weight of eucalyptus wood chips was pulped by a kraft digesting method in factory. The resultant unbleached pulp had a kappa value of 20.1 and pulp viscosity of 0.041 Pa·s (41 cP). The unbleached pulp was subjected to an alkali-oxygen bleaching procedure in a pulp consistency of 10% by weight in an aqueous solution of 1.20% by weight of sodium hydroxide based on the bone dry weight of the pulp, with a compressed oxygen gas under a gauge pressure of 4,990,332.50 Pa (5 kg/cm$^2$), at a temperature of 100° C. for 60 minutes. The bleached pulp had a kappa value of 9.6 and a pulp viscosity of 0.0251 Pa·s (25.1 cP).

Enzyme Treatment

The pulp was collected through a 100 mesh filter cloth, washed with water and a pulp slurry having a pulp consistency of 10% by weight was prepared. The pH value of the pulp slurry was adjusted to a level of 8.0 by adding a diluted aqueous sulfuric acid solution, and mixed with xylanase produced by Bacillus·SP-s-2113 strain (Life Engineering Industry Technical Laboratory, Industrial Technical Agency, The Ministry of International Trade and Industry, deposited strain FERM BP-5264), in an amount of one unit per gram of the pulp, and the resultant enzyme treatment system was heated at a temperature of 60° C. for 120 minutes. After the treatment was completed, the pulp residue was collected by a filtration through a 100 mesh filter cloth, and a filtrate having a volume of 1050 liters, a total saccharide concentration of 3700 mg/liter and a total saccharide amount of 3900 g, was obtained.

Permeation Treatment

The filtrate was subjected to a permeation treatment through a reverse osmosis membrane (trademark: RO NTR-7410, made by NITTO DENKO CORPORATION, membrane-forming material: sulfonated polyethersulfon polymer, common salt-rejection: 10%), to concentrate the filtrate at a volume ratio of the filtrate to a non-permeated fraction of 40. The non-permeated fraction (saccharide concentrated solution) had a total saccharide amount of 2700 g and a total saccharide yield of 70%.

The permeated fraction was obtained in an amount of 1024 liters and had a total content of succharides of 1.17 mg/ml.

Bleaching Test by Using the Permeated Fraction Delivered from the Permeation Treatment The bleaching test was applied to the resultant permeated fraction in the same testing method as in Example 1.

The resultant alkali-oxygen bleached hardwood pulp had a Kappa value of 9.0 and a Hunter whiteness of 44.1%.

The test results are shown in Table 1.

Example 5

A mixed hardwood chips consisting of 70% by weight of Japanese hardwood chips and 30% by weight of eucalyptus wood chips was pulped by a kraft digesting method in factory. The resultant unbleached pulp had a kappa value of 20.1 and pulp viscosity of 0.041 Pa·s (41 cP). The unbleached pulp was subjected to an alkali-oxygen bleaching procedure in a pulp consistency of 10% by weight in an aqueous solution of 1.20% by weight of sodium hydroxide based on the bone dry weight of the pulp, with a compressed oxygen gas under a gauge pressure of 4,990,332.50 Pa (5 kg/cm$^2$), at a temperature of 100° C. for 60 minutes. The bleached pulp had a kappa value of 9.6 and a pulp viscosity of 0.0251 Pa·s (25.1 cP).

The pulp was collected through a 100 mesh filter cloth, washed with water and a pulp slurry having a pulp consistency of 10% by weight was prepared. The pH value of the pulp slurry was adjusted to a level of 8.0 by adding a diluted aqueous sulfuric acid solution, and mixed with xylanase produced by Bacillus·SP-s-2113 strain (Life Engineering Industry Technical Laboratory, Industrial Technical Agency, The Ministry of International Trade and Industry, deposited strain FERM BP-5264), in an amount of 1.5 unit per gram of the pulp, and the resultant enzyme treatment system was heated at a temperature of 60° C. for 120 minutes. After the treatment was completed, the resultant pulp was washed with water in a displacement press washer and the washed pulp was collected by a filtration and a washing filtrate having a total saccharide concentration of 2000 mg/liter was obtained.

The washing filtrate in an amount of 2,000 liters was filtered through a bag filter (trademark: PO-10P2P, made by ISP FILTERS PTE LTD) to remove water-insoluble solid impurities. The washing filtrate had a water-insoluble impurity content of 350 ppm, and the bag-filtered filtrate had a water-insoluble impurity content of 79 ppm. The water-insoluble impurity content of the filtrate was confirmed by measuring a SS concentration of the filtrate.

Each of the washing filtrate and the bag-filtrate was further filtered through a glass filter (trademark: ADVANTEC GA100, made by TOKYO POSHI KAISHA, LTD. and having a filter size of 47 mm); a water-insoluble fraction caught by the glass filter was dried at 105° C. for one hour; and the dry weight of the water-insoluble fraction was measured.

Separately, the same washing filtrate as that mentioned above in an amount of 2,000 liters was mixed with a cationic synthetic polymeric flocculant (trademark: ACOFLOCK C 492UH, made by MITSUI SYTEC) in an amount of 15 ppm based on the weight of the filtrate, the mixed filtrate was agitated to form flocculate. The flocculate-containing filtrate was filtered through a bag filter having a micron rate of 10 μm, to provide a clear filtrate. The bag-filtered filtrate contained 11 ppm of water-insoluble impurities.

Further, separately, the washing filtrate in an amount of 2,000 liters was mixed with a cationic natural organic polymeric flocculant (trademark: KIMITSUCHITOSAN L, made by KIMITSU KAGAKUKOGYO K.K.) in an amount of 50 ppm based on the weight of the washing filtrate; and the mixture was agitated to allow a flocculate to be generated. The flocculate-containing filtrate was filtered through a bag filter having a micronrate of 10 μm to provide a clear filtrate. In this clear filtrate, the water-insoluble impurities remained in an amount of 13 ppm. No loss of the saccharides due to the flocculate formation and the flocculate-filtration was found.

When a anionic flocculant or a non-ionic flocculant was added each in an amount of 50 ppm to the filtrate, no flocculate could be generated, as shown in Table 6.

Each of the above-mentioned three types of flocculant-treated filtrates derived from the washing filtrate was subjected to a permeation treatment through two pieces of a reverse osmosis membrane (trademark: RO-NTR-7450, membrane material: sulfonated polyether-sulfon polymer, salt rejection: 50% membrane area: 6.2 $m^2$), at a filtrate temperature of 50° C., under inlet operation pressure of 980,665 to 1,961,330 Pa (10 to 20 $kgf/cm^2$), at a flow rate of 1400 to 1800 liters/hr, at a concentration rate of 20:1. The inlet operation pressure was raised at a raising rate of 196,133 Pa/hr (2 $kgf/cm^2 \cdot hr$).

(1) In the case of the filtrate (1) which was passed through the 10 μm bag filter to remove the water-insoluble impurities, the permeation rate of the filtrate through the reverse osmosis membrane was 39 $liters/hr \cdot m^2$ at the initial stage of the permeation procedure and 7 $liters/hr \cdot m^2$ at the final stage at which the concentration ratio reached 20:1. Thus, during the permeation procedure, the reduction rate in the permeation rate of the filtrate was 80% or more.

(2) In the case of the filtrate (2) which was passed through the 10 μm bag filter after the treatment with the cationic synthetic organic polymeric flocculant (trademark: Acoflock) was completed, the permeation rate of the filtrate through the reverse osmosis membrane was 38 $liters/hr \cdot m^2$ at the initial stage of the permeation procedure and 30 $liters/hr \cdot m^2$ at the final stage at which the concentration ratio reached 20:1. Thus, during the permeation procedure, the reduction rate in permeation rate of the filtrate was about 21%.

(3) In the case of the filtrate (3) which was passed through the 10 μm bag filter after the treatment with the cationic natural organic polymeric flocculant (trademark: KIMITSUCHITOSAN L) was completed, the permeation rate of the filtrate through the reverse osmosis membrane was 36 $liters/hr \cdot m^2$ at the initial stage of the permeation procedure and 28 $liters/hr \cdot m^2$ at the final stage at which the concentrating ratio reached 20:1. Thus, the reduction rate in the permeation rate of the filtrate during the permeation procedure was 22%.

The changes in the permeation rates of the above-mentioned three types of filtrates are shown in FIG. 1. In FIG. 1, curve 1 shows a relationship between the permeation rate of the filtrate (1) and the concentrating (permeating) time, curve 2 shows a relationship between the permeation rate of the filtrate (2) and the concentrating (permeating) time, and curve 3 shows a relationship between the permeation rate of the filtrate (3) and the concentrating (permeating) time.

Before the permeation treatment, the filtrate (1) in an amount of 2000 liters contains 4000 g of all the saccharides. The non-permeated fractions prepared from the filtrate (1), (2) and (3) in the concentrating ratio of 20:1 respectively had a total saccharide content of about 3400 g per 100 liters, and the respective recovery yield was 80%.

The permeated fraction was obtained in an amount of 1900 liters and had a total content of saccharides of 0.31 mg/ml. The permeated fraction was subjected to the same bleaching test as in Example 1.

The resultant alkali-oxygen bleached hardwood pulp had a Kappa value of 8.9 and a Hunter whiteness of 45.1%.

The test results are shown in Table 1.

Table 1 shows the reduction rate in kappa value of the pulp and the increase rate in whiteness of the pulp due to the alkali-oxygen bleaching procedure, and the pH value of the bleaching system after the alkali-oxygen bleaching procedure was completed.

TABLE 1

| Compound No. | | Before oxygen-bleaching: Kappa value | Before oxygen-bleaching: Whiteness (%) | After oxygen-bleaching: Content of sodium hydroxide (wt %) | After oxygen-bleaching: Kappa value | After oxygen-bleaching: Reduction rate in kappa value (%) | After oxygen-bleaching: Whiteness (%) | After oxygen-bleaching: Increase rate in whiteness (%) | After oxygen-bleaching: pH value after bleaching |
|---|---|---|---|---|---|---|---|---|---|
| Example | 1 | 16.1 | 32.7 | 1.2 | 9.1 | 43.5 | 44.5 | 36.1 | 9.9 |
| | 2 | 16.1 | 32.7 | 1.7 | 8.8 | 45.3 | 45.3 | 38.5 | 10.4 |
| | 3 | 16.1 | 32.7 | 2.2 | 8.7 | 46.0 | 45.9 | 40.4 | 10.8 |
| Comparative | 1 | 16.1 | 32.7 | 1.2 | 10.1 | 37.3 | 43.0 | 31.5 | 8.6 |
| Example | 2 | 16.1 | 32.7 | 2.2 | 9.1 | 43.5 | 44.4 | 35.8 | 9.9 |
| | 3 | 16.1 | 32.7 | 2.7 | 9.1 | 43.5 | 44.7 | 36.7 | 10.2 |
| Example | 4 | 16.1 | 32.7 | 1.2 | 9.0 | 44.0 | 44.1 | 34.9 | 9.4 |
| | 5 | 16.1 | 32.7 | 1.2 | 8.9 | 44.7 | 45.1 | 37.9 | 10.4 |

Table 1 clearly shows that when the permeated fraction obtained by the permeation treatment of the filtrate of the reaction mixture delivered from the enzyme treatment system through the separation membrane is used as a diluting water for the pulp in the alkali-oxygen bleaching system, the pH value of the alkali-oxygen bleaching system after the bleaching is completed increases, and thus the delignification of the pulp is significantly enhanced, and the amount of alkali to be added to the alkali-oxygen bleaching system can be greatly reduced, as shown in Examples 1 to 3.

When the filtrate of the reaction mixture delivered from the enzyme treatment system is employed as a diluting water for the pulp in the alkali oxygen-bleaching system, the pH of the alkali oxygen bleaching system is decreased after the bleaching procedure, and thus the delignification for the pulp is restricted, and the alkali addition to the bleaching system must be increased, as shown in Comparative Examples 1 and 2. Also, the reduction rate in kappa value reaches about 43.5%, the increase rate in the alkali addition does not promote the delignification of the pulp, as shown in Comparative Example 3.

In the process of the present invention, when the filtrate of the reaction mixture delivered from the enzyme treatment system is subjected to a permeation treatment through a separation membrane, for example, a reverse osmosis membrane, NF membrane or ultrafiltration membrane, and the resultant permeated fraction is employed as a liquid medium of the alkali-oxygen bleaching procedure, the amount of the alkali to be added to the bleaching system can be significantly reduced, the bleaching effect can be enhanced.

Example 6

The non-permeated fraction of Example 4 was subjected to a measurement of the contents of xylooligosaccharide and xylooligosaccharide-lignin complex by an ion chromatography (column for ion-chromatography: PA-10) made by DIONEX CO.

The determination result in shown in Table 2.

Figure 2:
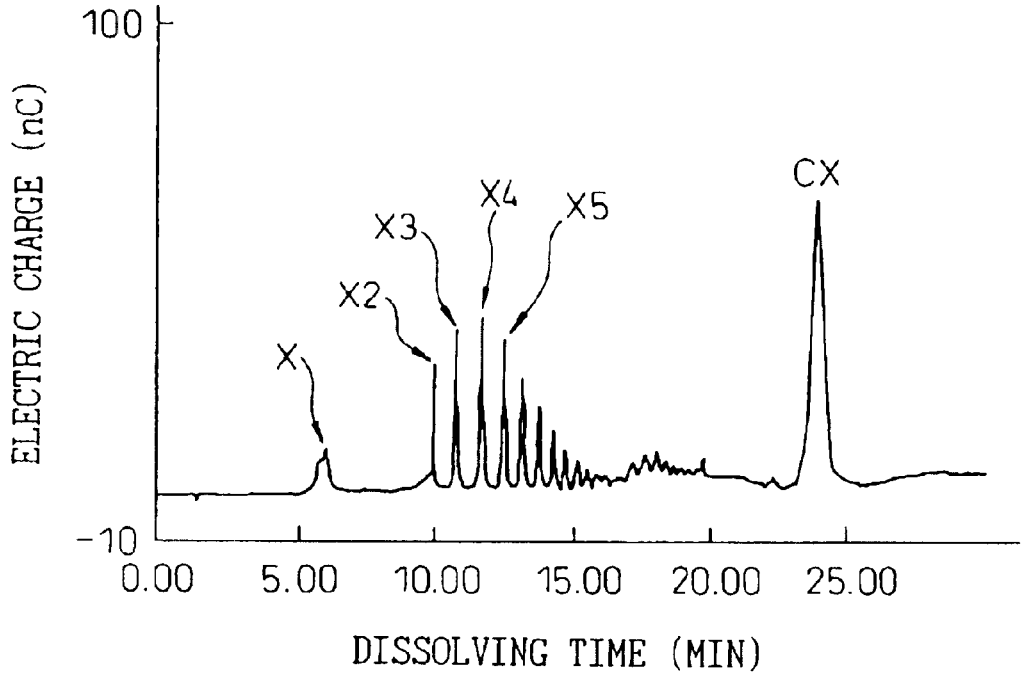
FIG. 2 is a chromatogram of a non-permeated fraction obtained by a reverse osmosis treatment of Example 6.

FIG. 2 shows a chromatogram of a sample which was prepared by heating the non-permeated fraction at a pH value of 5.0 at a temperature of 121° C. for one hour and diluting the heated sample with water at a diluting volume ratio of 1/100.

In FIG. 2, the axis of ordinates shows the electric charge (nC) of the analysis sample, and the axis of abscissas shows the dissolving time (minute) of the analysis sample. Also, in FIG. 1, a peak x represents a monomer of xylose in a dissolving time of 6 minutes, $x_2$ dimer of xylose in a dissolving time of 9.2 minutes, $x_3$ trimer of xylose in a dissolving time of 10.3 minutes, $x_4$ tetramer of xylose in a dissolving time of 11.4 minute), $x_5$ pentamer of xylose in a dissolving time of 12.5 minutes, followed by peaks corresponding to hexamer, heptomer . . . , and a peak CX represents xylooligosaccharide-lignin complex in a dissolving time of 23.8 minutes. FIG. 2 and Table 2 clearly show that the content of the xylooligosaccharide in the non-permeated fraction (saccharide-concentrated solution) was low.

Example 7

A sample of the same non-permeated fraction (saccharide-concentrated solution) as in Example 4 was added with sulfuric acid to adjust the pH value of the non-permeated fraction to 3.5. The sample having a pH value of 3.5 was heated at a temperature of 121° C. for one hour.

Figure 3:
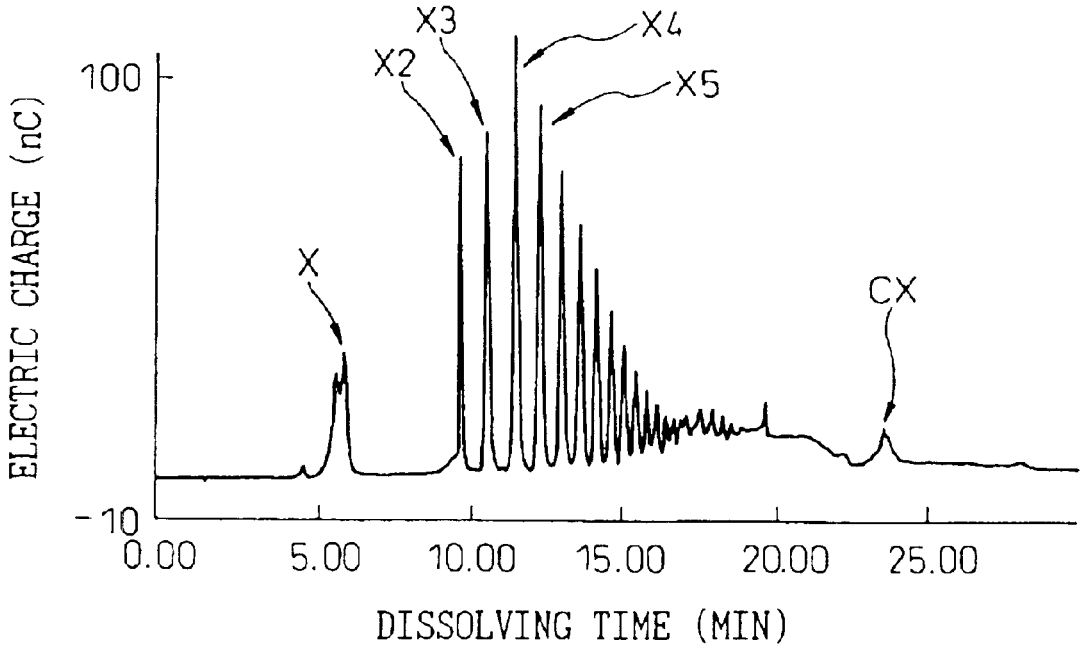
FIG. 3 is a chromatogram of a heat treatment product of the non-permeated fraction of Example 4, obtained in Example 7.

The resultant sample was subjected to the same ion-chromatographic analysis using a ion chromatographic column (trademark: PA-10, made by DIONEX CORPORATION). For the analysis results, it was found in comparison with the analysis results of Example 6 that the heat treatment caused the production of the xylooligosaccharides (including di- to deca-mers of xylose to be promoted. The results are shown in FIG. 3. FIG. 3 shows a chromatogram of a sample of the non-permeated fraction having a pH of 3.5, heat treated at 121° C. for one hour, and diluted with water in a diluting ratio of 40.

In FIG. 3, the electric charge (in nC) of the analysis sample is shown on the axis of ordinates, and the dissolving time (in minute) of the analysis sample is shown on the axis of abscissas.

In FIG. 3, a peak of xylose monomer is exhibited at a dissolving time of 6 minute, a peak of xylose dimer at a dissolving time of 9.2 minutes, a peak of xylose trimer at a dissolving time of 10.3 minutes, a peak of xylose tetramer at a dissolving time of 11.4 minutes, a peak of xylose pentamer at a dissolving time of 12.5 minutes, followed by peaks corresponding to hexa- and hepta- or more mers of xylose, and a peak of xylooligosaccharide complex at a dissolving time of 23.8 minutes.

Namely FIG. 3 shows that the heat treatment of the non-permeated fraction in Example 7 contributed to promoting the production of the xylooligosaccharides (di- to deca-mers of xylose), in comparison with that in Example 6.

TABLE 2

| Item | | | | | | | | | | | | |
|---|---|---|---|---|---|---|---|---|---|---|---|---|
| | | Heat, acid treatment | | | | Product percentage of area of peak portion on chromatogram | | | | | | |
| Example No. | | Type of acid | pH | Temperature (° C.) | Time (min) | X(%) | X2(%) | X3(%) | X4(%) | X5(%) | >X6(%) | CX(%) |
| Example | 6 | — | — | — | *** | 6.4 | 5.7 | 7.8 | 7.6 | 2.1 | 0.0 | 70.4 |
| | 7 | Sulfuric acid | 1.5 | 121 | 60 | 57.6 | 20.1 | 15 | 5.8 | 0.4 | 0.8 | 0.3 |

[Note]
X: Xylose, $X_2$: Xylobiose, $X_3$: Xylotriose, $X_4$: Xylotetraose, $X_5$: Xylopentaose, $>X_6$: Xylohexaose and higher oligomers, CX: Xylooligosaccharide complex.

What is claimed is:

1. A process for bleaching a lignocellulose pulp comprising the steps of:

(1) bleaching a pulp in an aqueous alkali solution with oxygen;

(2) enzyme-treating the pulp with hemicellulase to an extent such that a liquid fraction containing saccharides in a total amount of 2 to 6 mg/ml is produced in the resultant reaction mixture;

(3) filtering the resultant reaction mixture delivered from the enzyme-treating step (2) to recover the enzyme-treated pulp separated from the liquid fraction of the reaction mixture;

(4) mixing the liquid fraction of the filtration step (3) with a flocculant selected from the group consisting of inorganic flocculants, and polymeric flocculants, and removing the resultant flocculate from the filtrate;

(5) subjecting the flocculate-free liquid fraction delivered from the filtration step (4) to a permeation treatment through a separation membrane to separate a permeated fraction from a non-permeated fraction; and (6) feeding the resultant permeated fraction delivered from the permeation treatment step (5) to the alkali-oxygen bleaching step (1) to use it as a liquid medium of the alkali-oxygen bleaching step (1).

2. The bleaching process as claimed in claim 1, wherein the enzyme treatment step (2) is carried out after the alkali-oxygen bleaching step (1).

3. The bleaching process as claimed in claim 1, wherein the enzyme treatment is carried out by using, as a hemicellulase, xylanase.

4. The bleaching process as claimed in claim 1, wherein the pulp is selected from chemical pulps.

5. The bleaching process as claimed in claim 1, wherein in the permeation treatment through the separation membrane, a membrane for reverse osmosis or for nanofiltration is used.

* * * * *